US007309183B2

(12) United States Patent
Dumler

(10) Patent No.: US 7,309,183 B2
(45) Date of Patent: Dec. 18, 2007

(54) COSMETIC UNIT, ESPECIALLY MASCARA UNIT

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 24 days.

(21) Appl. No.: 11/159,212

(22) Filed: Jun. 23, 2005

(65) Prior Publication Data

US 2005/0286965 A1 Dec. 29, 2005

(30) Foreign Application Priority Data

Jun. 23, 2004 (EP) ..... 04014677

(51) Int. Cl.
*B43K 5/04* (2006.01)
*A46B 11/00* (2006.01)

(52) U.S. Cl. ..... 401/155; 401/122; 401/121; 401/126; 401/129

(58) Field of Classification Search ..... 401/122, 401/121, 126, 129; 132/212, 218
See application file for complete search history.

(56) References Cited

U.S. PATENT DOCUMENTS 4,175,574 A * 11/1979 Zulberti ..... 401/122
4,390,298 A * 6/1983 Carluccio ..... 401/122
4,810,122 A * 3/1989 Cole ..... 401/122
4,841,996 A * 6/1989 Gueret ..... 401/129
4,886,387 A * 12/1989 Goldberg et al. ..... 401/122
5,349,972 A 9/1994 Dirksing et al.
5,490,737 A * 2/1996 Gueret ..... 401/122
5,597,254 A * 1/1997 Vasas ..... 401/122
5,697,720 A * 12/1997 Lhuisset ..... 401/122
5,884,634 A * 3/1999 Sheffler et al. ..... 401/122
6,062,757 A 5/2000 Gueret
6,280,113 B1 * 8/2001 Gueret ..... 401/122
6,345,626 B1 * 2/2002 Bouix ..... 132/218
6,695,513 B1 * 2/2004 Malek ..... 401/129
2001/0019680 A1 9/2001 Horstman, et al.
2004/0240926 A1 * 12/2004 Gueret ..... 401/122
2005/0232681 A1 * 10/2005 Gueret ..... 401/129

FOREIGN PATENT DOCUMENTS

DE 197 44 181 A 4/1999

* cited by examiner

*Primary Examiner*—Khoa D. Huynh
(74) *Attorney, Agent, or Firm*—Browdy and Neimark, PLLC

(57) ABSTRACT

A cosmetic unit, especially a mascara unit, comprises a storage container for a mascara liquid, a closing cap for placing onto the storage container, an applicator rod incorporating an applicator and extending away from the inside of the closing cap through an orifice, and a wiper means placed in the orifice of the container, wherein the wiper means extends sufficiently far from the edge of the orifice into the interior of the container so that the wiper orifice or the wiper lips of the wiper means, when the applicator is in the inserted condition, extend to the region of the proximal edge of the applicator.

6 Claims, 1 Drawing Sheet

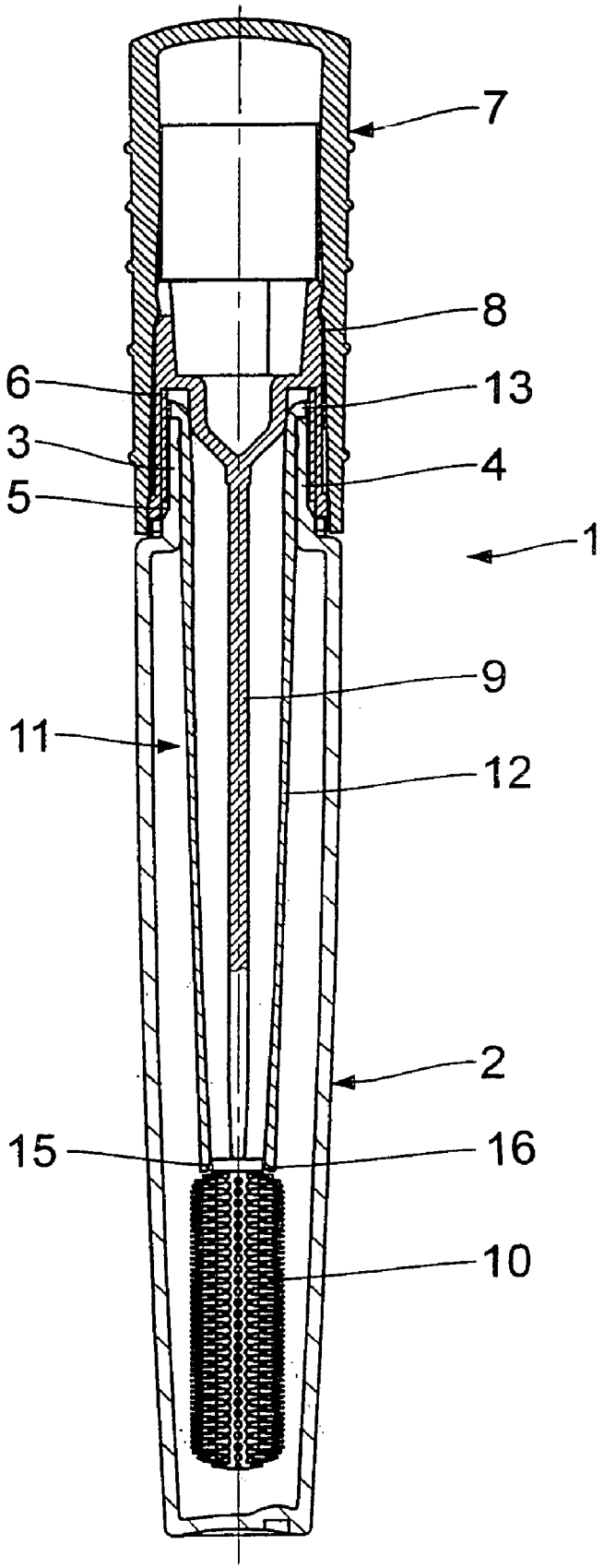
7
8
6
13
3
4
5
1
9
11
12
2
15
16
10

COSMETIC UNIT, ESPECIALLY MASCARA UNIT

FIELD OF THE INVENTION

The invention is directed to a cosmetic unit, especially a mascara unit, comprising a storage container for a mascara liquid, a closing cap for placing onto the storage container, an applicator rod incorporating an applicator and extending away from the inside of the closing cap through an orifice, and a wiper means placed in the orifice of the container.

BACKGROUND OF THE INVENTION

Wiper means of this type serve to wipe off excess mascara liquid when the applicator, especially a mascara brush, is withdrawn, so that an even, drip-free and clump-free application of the mascara liquid onto the eyelashes is ensured.

Another function of the wiper means consists of enclosing the rod in a sealing manner when the applicator is not in use, i.e., when the applicator with the rod is inserted in the container, in order to prevent the mascara liquid from leaking out. The diameter of the rod must accordingly be adapted to the diameter of the wiper means, with the diameter of the wiper means, in turn, needing to be adapted to the diameter of the applicator.

SUMMARY OF THE INVENTION

This results in constructional limitations with respect to the design of the rod. The invention, accordingly, is based on the object of creating a cosmetic unit, especially a mascara unit, that opens up greater freedoms of design and specifically also permits a more efficient, more cost-effective production with respect to the rod.

From U.S. Pat. No. 4,810,122 B 1, a wiper means is known, which is elongated along the rod in the axial direction and which extends to approximately the middle of the rod and terminates at a corresponding distance from the applicator.

The above object is met according to the invention in such a way that the wiper means extends sufficiently far from the edge of the orifice into the interior of the container so that the wiper orifice or the wiper lips of the wiper means, when the applicator is in the inserted condition, extend to the region of the proximal edge of the applicator, i.e., to its inner end, so that in the inserted condition, the applicator rod is located within the wiper means and the applicator is located outside the same. The geometry of the rod, except for its distal end region, can accordingly be freely selected and particularly also relatively thin rods may be used, which can be manufactured quickly and inexpensively. The rods may then also exhibit a certain amount of elasticity, which may enhance the application process, wherein the rod has a considerably smaller diameter compared to the basic diameter of the applicator.

In an additional embodiment of the invention, provision may be made for the wiper means to have an intrinsic stiffness such that it remains substantially rigid despite its distal extension when the applicator is withdrawn.

The edge of the wiper orifice or the wiper lips of the wiper means advantageously consist of a softer material than the main body.

In this respect it may prove advantageous that the main body of the wiper means consists of harder synthetic material and the edge of the wiper orifice or the wiper lips of softer synthetic material and they are produced by means of coextrusion.

The main body of the wiper means preferably has an elongated, frusto-conical basic shape.

BRIEF DESCRIPTION OF THE DRAWING

The invention will be explained in more detail below based on a preferred example embodiment in connection with the drawing, which shows a longitudinal section through an inventive mascara unit.

DESCRIPTION OF THE PREFERRED EMBODIMENT

A mascara unit 1 shown in the drawing comprises a container 2 for the mascara liquid, with an orifice 3 at the top.

In the region of the orifice 3 the container 2 incorporates a container neck 4 with a reduced outside diameter relative to the container 2 below the neck and with an external thread 5 onto which the internal thread 6 of a screw cap 7 can be screwed.

In the interior of the screw cap 7 a pot-like insert 8 serves to secure an applicator rod 9 on whose distal outer end an applicator 10 is fixed in the form of a mascara brush. As shown in the drawings, the diameter of the applicator rod 9 is smaller than the diameter of the applicator 10.

A wiper means 11 incorporates an elongated, frusto-conical main body 12 tapers at the same angle over its entire length that rests at its top with an annular collar 13 on the upper edge of the orifice 3.

As shown on the drawing, the distal extension of the main body 12 of the wiper means 11 into the container 2 is selected sufficiently long so that the edge of the orifice 15, which serves as the wiper lips 16 of the wiper means 11 terminates substantially adjacent to the proximal end of the applicator 10, i.e., the applicator rod 9 is encompassed along its entire length by the main body 12 of the applicator 10 and does not close the wiper means 11. As further seen in the drawing, the diameter of the orifice 15 of the wiper means 11 is slightly smaller in a manner known per se than the outside diameter of the applicator 10. In the preferred embodiment of the invention the wiper lips 16 have at the wiper orifice 15 a radius of 0.2 to 5.0 mm.

This embodiment has the advantage that the diameter of the rod 9 can be selected completely independently from the container 2 so that, for example, also rods with a diameter smaller than 4.3 mm may be used, whose production is advantageous in injection molding, since shorter cycle times are attainable. The diameter of the rod 9 merely needs to be selected such in the region of the orifice 15 of the wiper means that the orifice 15 is sealed when the rod 9 is in the inserted condition.

What is claimed is:

1. A cosmetic unit, especially a mascara unit, comprising a storage container for a mascara liquid, a closing cap for placing onto the storage container, an elastic applicator rod incorporating an applicator and extending away from the inside of the closing cap through an orifice of the container, and a wiper element fixed in the orifice of the container, wherein the wiper element (11) tapers at the same angle from the edge of the orifice (3) into the interior of the container (2) over the entire length thereof to an annular wiper orifice or annular wiper lips so that the wiper orifice (15) or the wiper lips (16) of the wiper element (11), when the applicator (10) is in the inserted condition, are substantially adjacent to the proximal edge of the applicator (10) and, in the inserted condition, the applicator rod (9) is enclosed along an entire length thereof within the wiper element (11) without the applicator rod closing the wiper element, wherein the applicator (10) is located outside the wiper element, and wherein the rod (9) is thin and has a smaller diameter compared to the diameter of the applicator (10).

2. A cosmetic unit according to claim 1, wherein the wiper element (11) has an intrinsic stiffness such that it remains substantially rigid despite its distal extension when the applicator (10) is withdrawn.

3. A cosmetic unit according to claim 1, wherein the wiper element (11) has an elongated, frusto-conical basic shape.

4. A cosmetic unit according to claim 1, wherein the applicator (10) consists of synthetic material.

5. A cosmetic unit according to claim 1, wherein the wiper lips (16) have, at the wiper orifice (15) a radius of 0.2 to 5.0 mm.

6. A cosmetic unit according to claim 1, wherein the wiper lips (16) are composed of rubber and produced by means of injection molding and vulcanizing.

* * * * *